US006626428B2

(12) United States Patent
Soga et al.

(10) Patent No.: US 6,626,428 B2
(45) Date of Patent: Sep. 30, 2003

(54) SHEET EJECTION MECHANISM

(75) Inventors: Naofumi Soga, Tokyo (JP); Kazumasa Yasui, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/029,276

(22) Filed: Dec. 28, 2001

(65) Prior Publication Data

US 2003/0122299 A1 Jul. 3, 2003

(51) Int. Cl.[7] ..... B65H 29/68

(52) U.S. Cl. ..... 271/182; 271/186; 271/202; 271/314

(58) Field of Search ..... 271/182, 202, 271/314, 207, 186

(56) References Cited

U.S. PATENT DOCUMENTS 4,073,223 A * 2/1978 Crawford ..... 271/182 X
4,569,514 A * 2/1986 Holtje ..... 271/314
4,696,463 A * 9/1987 Nakazato et al. ..... 271/182 X
4,995,859 A * 2/1991 Totani ..... 271/182 X
5,215,300 A * 6/1993 Hiroi et al. ..... 271/182 X
5,449,163 A * 9/1995 Wong et al. ..... 271/186
6,186,497 B1 * 2/2001 Johnston ..... 271/186

FOREIGN PATENT DOCUMENTS

JP 9-104555 4/1997

* cited by examiner

*Primary Examiner*—David H. Bollinger
(74) *Attorney, Agent, or Firm*—Foley & Lardner

(57) ABSTRACT

A copier has an ejection mechanism for allowing a sheet with a formed image to be ejected via an ejection exit toward the outside of the machine. The ejection mechanism has a switch-back section for allowing the sheet which is passed through a fixing unit at a predetermined process speed to be received for the sheet to be inverted and an ejection roller pair for allowing the sheet which is sent from the switch-back section to be decelerated before the ejection exit and to be sent to the outside of the machine. In order to maintain a conveying pitch at which sheets are continuously delivered, the conveying speed of the sheet passed through the switch-back section is increased, thus shortening the inversion operation time required for the switch-back operation. That is, the conveying speed of the sheet passed through the switch-back section is made higher than the process speed. The thus increased sheet conveying speed is decelerated in a passage of the sheet through the ejection roller pair, so that the ejection of the sheet is prevented.

10 Claims, 3 Drawing Sheets

SHEET EJECTION MECHANISM

BACKGROUND OF THE INVENTION

The present invention relates to a sheet ejection mechanism for allowing sheets on which images have been formed by a copier, printer, etc., to be ejected toward an out of the image-forming machine.

Generally, a sheet on which an image has been formed by a copier is ejected onto a sheet ejection tray while being maintained at the process speed of the copier.

In a high-speed machine involving a relatively high process speed, however, when a thicker sheet, etc., is ejected, ejection of the sheet from the sheet ejection tray has sometimes been encountered.

In a high-speed machine of such a type as to eject a sheet with an image-formed surface side inverted, even if a plain sheet of paper is involved, there are sometimes cases where, since at the ejection of the plain sheet the conveying speed of the sheet is faster than the process speed, ejection of the sheet from the sheet ejection tray occurs. In this sheet reverse turn type high-speed machine, when the plain sheet is switched back, the conveying speed of the sheet is made faster than the process speed, thus shortening a time required for a switch-back operation and avoiding a sheet-to-sheet collision at the switch-back section. When, therefore, the sheet is ejected at the same speed as an accelerated sheet conveying speed, then there are sometimes the cases where, even in the use of the plain sheet, the ejection of the sheet past the sheet ejection tray occurs.

If, in this way, a thin sheet, plain sheet, or the like is ejected past the sheet ejection tray, there occurs a problem that the sheet is soiled or torn. Even if the sheet is ejected onto the sheet ejection tray without being ejected, there are also cases where those ejected sheets are irregularly stacked on the sheet ejection tray.

BRIEF SUMMARY OF THE INVENTION

The present invention is achieved with the above in view and the object of the present invention is to provide a sheet ejection mechanism that can eject sheets stably.

In order to achieve the above-mentioned object, a sheet ejection mechanism comprising: an ejection exit for allowing a sheet which is conveyed at a predetermined process speed through an image forming section to be ejected toward an outside of an image forming machine, the sheet having an image formed at least on one surface; a feeding mechanism for feeding the sheet, which is sent from the image forming section, at a first speed toward the ejection exit; and a speed reducing mechanism, provided near the ejection exit, for allowing the sheet which is sent by the feeding mechanism to be decelerated to a second speed lower than the first speed.

Further, a sheet ejection mechanism comprising: an ejection exit for allowing a sheet which is conveyed at a predetermined process speed through an image forming section to be ejected toward an outside of an image forming machine, the sheet having an image formed on one surface; a switch-back section for allowing the sheet which is sent from the image forming section to be conveyed at a first speed, the switch-back section turning a sheet conveying direction to a reverse direction to invert the sheet from one surface side to the other surface side; and a speed reducing mechanism, provided near the ejection exit, for allowing the sheet which is sent from the switch-back section to be decelerated to a second speed lower than the first speed and to be ejected via the ejection exit.

Still further, a sheet ejection mechanism comprising: an ejection exit for allowing a plurality of sheets which are conveyed at a predetermined conveying interval and at a predetermined process speed through an image forming section to be continuously ejected to an outside of an image forming machine, the respective sheet having an image formed on one surface; a switch-back section for allowing the respective sheets which are sent from the image forming section to be conveyed at a first speed and their conveying direction to be sequentially turned to a reverse direction to invert the sheet from one surface side to the other surface side; a speed reducing mechanism, provided near the ejection exit, for allowing the respective sheets which are, sent from the switch-back section to be decelerated to a second speed lower than the first speed and to be sequentially ejected via the ejection exit; and a control section for controlling the first speed to approximately the process speed when the conveying interval is longer than the length of the sheet along the conveying direction and the first speed to a higher speed than the process speed when the conveying interval is less than the length of the sheet along the conveying direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The embodiment of the present invention will be explained in more detail below by referring to the accompanying drawing.

Figure 1:
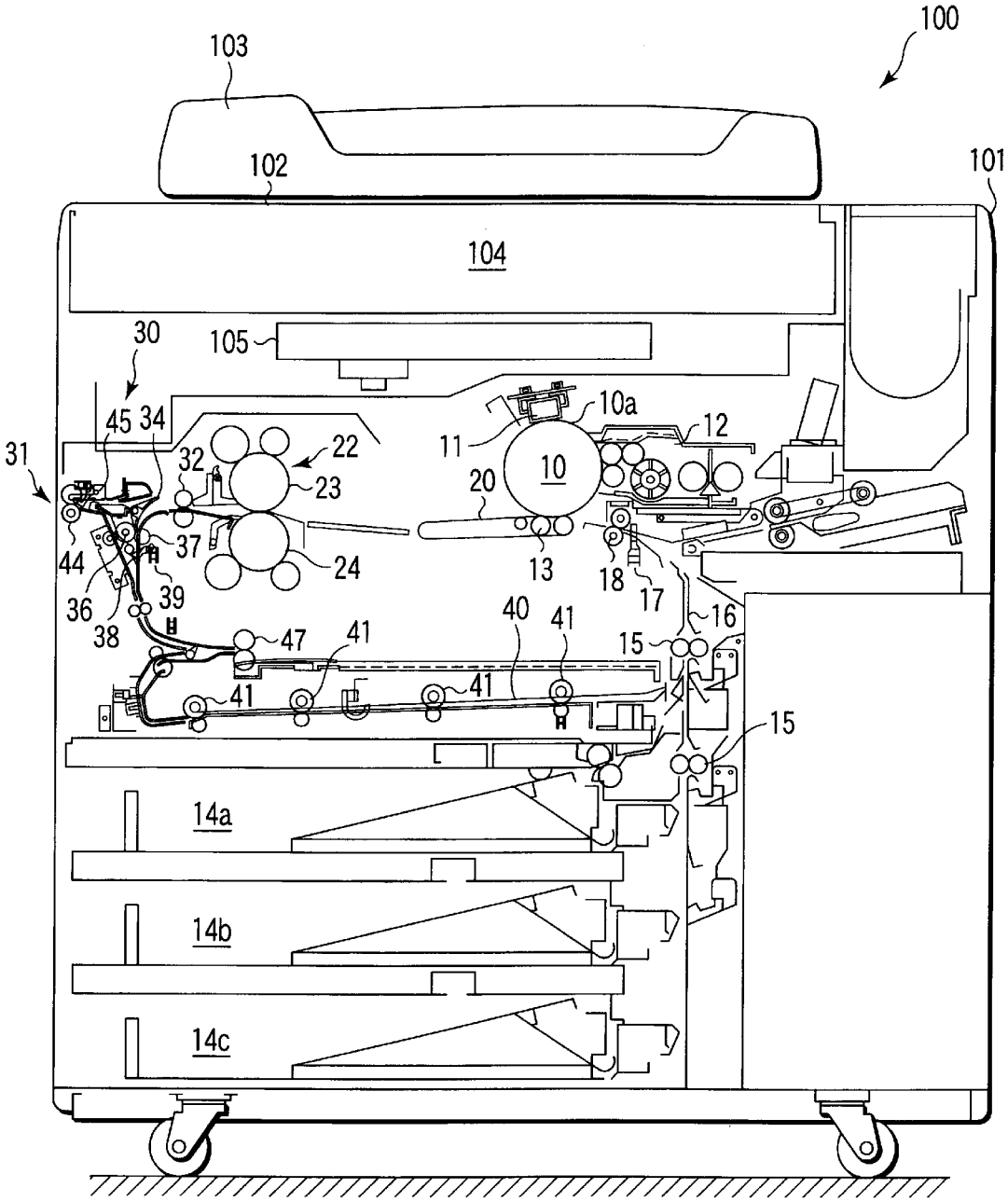
FIG. 1 is a diagrammatic view showing a copier according to an embodiment of the present invention.

FIG. 1 shows a diagrammatic view showing a general structure of a copier 100 according to the embodiment of the present invention. The copier 100 has a housing 101 constituting an outer casing of the apparatus. A document glass 102 is provided on the upper surface of the housing 101 to place a document on. An automatic document feeder (ADF) 103 is so set over the document glass 102 as to be openable/closable relative to the document glass. The ADF 103 covers the document placed on the document glass 102 and, further, automatically feeds a document to a predetermined position on the document glass 102.

A scanner unit 104 is provided below the document glass 102 and within the housing 101. The scanner unit 104 reads an image from the document by directing light onto the document placed on the document glass 102 and obtaining its reflected light. Further below the scanner unit 104 a light exposure unit 105 is provided. The light exposure unit 105 illuminates a surface 10*a* of a photosensitive drum 10 with a laser beam based on image data read out by the scanner unit 104 and, by doing so, enables the scanning of its light on the drum surface 10*a*, so that an electrostatic latent image is formed on the drum surface 10*a* on the basis of the image data. The detailed structures of the scanner unit 104 and light exposure unit 105 have no relevancy to the essential features of the present invention and their illustration is, therefore, omitted.

Around the photosensitive drum 10, a charger 11, developing unit 12, transfer unit 13, etc., are provided as other constituent elements for performing the conventionally known electrophotographic process. The charger 11 charges the drum surface 10*a* to a predetermined potential. The developing unit 12 supplies a developing agent to the electrostatic latent image formed on the drum surface 10*a* by the light exposure unit 105 and develops the latent image with the developing agent to form a developing agent image on the drum surface 10*a* based on the image data. The transfer unit 13 imparts an electric charge to a sheet conveyed through a transfer area between it and the photosensitive drum 10 to electrostatically transfer the developing agent which has been formed on the drum surface 10*a* onto the sheet.

Below the photosensitive drum 10, a plurality of stages of sheet supply cassettes 14*a*, 14*b*, 14*c* are provided. They contain different sizes and kinds of sheets. Any sheet taken from a respective one of the sheet supply cassettes 14*a*, 14*b*, 14*c* is supplied toward the photosensitive drum 10 through a sheet conveying path 16 equipped with a plurality of pairs of supply rollers 15.

The sheet which is supplied toward the photosensitive drum 10 is passed through an aligning switch 17 and then aligned by an aligning roller 18. And the aligning roller 18 is rotated in a way to match the conveying timing of the developing agent image on the drum surface 10*a*, and the aligned sheet is fed into a transfer area. At this time, an electric charge is imparted by the transfer unit 13 to allow the developing agent image which is formed on the drum surface 10*a* to be transferred to the sheet. The speed at which the sheet is fed into the transfer area is set to the peripheral speed of the photosensitive drum 10, that is, to the same speed as the process speed in the performing of the electrophotographic process.

The sheet which has been passed through the transfer area with the developing agent transferred thereto is conveyed, at the same speed as the process speed, toward a fixing unit 22 through a conveying belt 20. The fixing unit 22 has a heating roller 23 provided above the conveying path and a pressure applying roller 24 set in pressure contact with the heating roller 23 with the conveying path therebetween. The developing agent image-fixed sheet having passed through a nip between the rollers 23 and 24 in the fixing unit 22 is ejected, via an ejection exit at the housing 101, to the outside of the machine by means of a sheet ejection mechanism 30 (hereinafter referred to simply as an ejection mechanism 30) according to the embodiment of the present invention as will be set out below.

In the case of forming an image on each surface of a sheet, a sheet having an image formed on one surface, after being passed through the fixing unit 22, is inverted by a later-described switch-back section 35 of the ejection mechanism 30 and guided toward a "both-surfaces" handlable conveying path 40. The conveying path 40 includes a plurality of pairs of feed rollers 41. The sheet which has been passed through the conveying path 40 is sent into a nip of the sheet supply roller pair 15 located more on an upstream side in the sheet supplying direction than an aligning switch 17 and again is fed into the transfer area.

Figure 2:
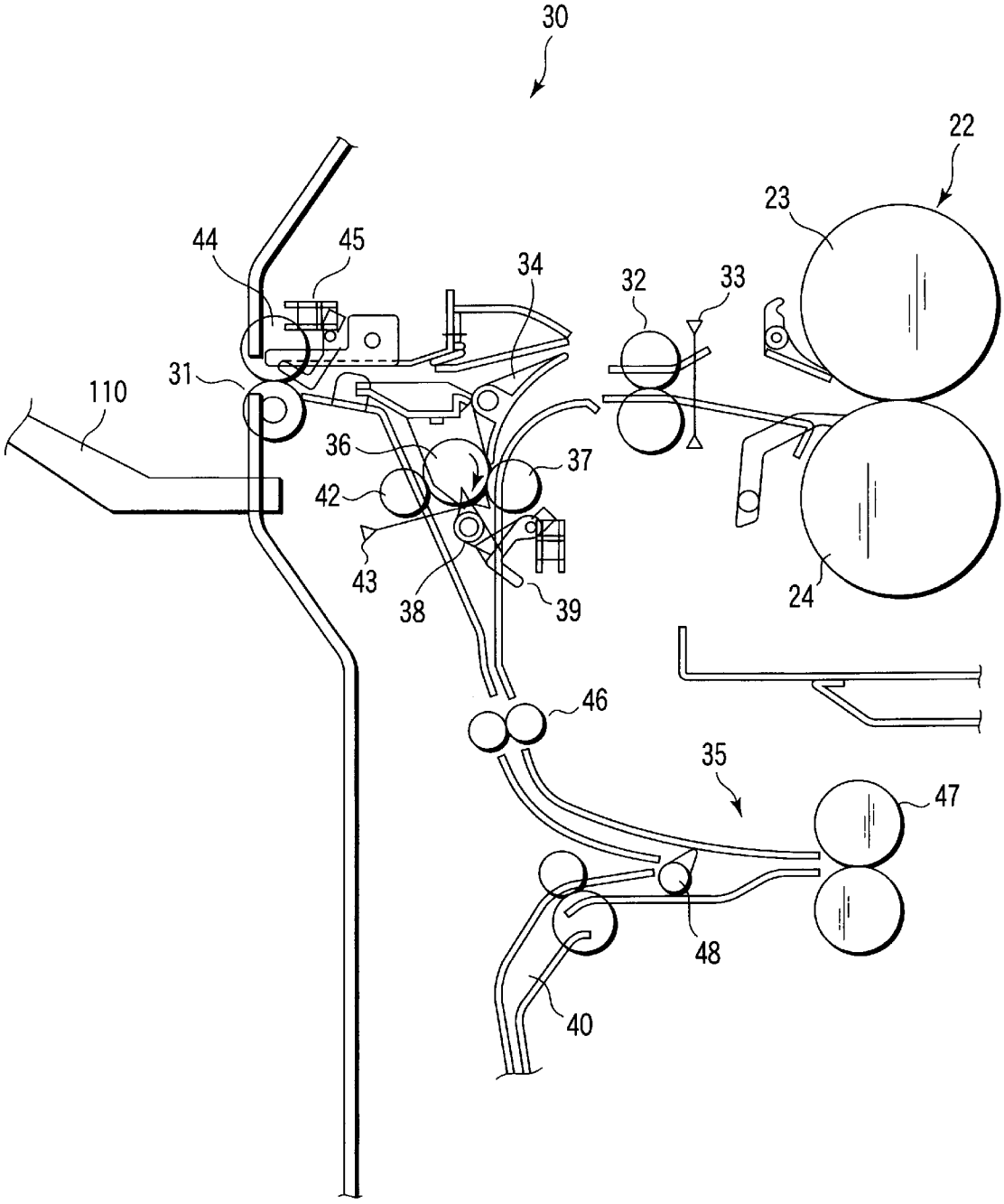
FIG. 2 is a diagrammatic view showing a sheet ejection mechanism incorporated into the copier in FIG. 1.

FIG. 2 is an enlarged view showing the ejection mechanism 30.

The ejection mechanism 30 has a pair of feed rollers 32 (feeding mechanism) provided more on a downstream side in the sheet conveying direction than the fixing unit 22. The feed rollers 32, while being rotated, allow a sheet having a formed image at least on one surface which has been passed through a nip between the pair of rollers 23, 24 to enter into their nip. According to the present embodiment, the feeding speed of the sheet by the pair of feed rollers 32 is set to about the process speed (about 400 mm/s). In a place near the nip on the upstream side of the feed roller pair 32, a sensor 33 is provided to detect the passage of the sheet.

On the conveying path more on a downstream side than the feed roller pair 32 a gate 34 is provided for selectively switching the conveying direction of the sheet. The gate 34 is switched between a position at which the conveying direction of the sheet is toward the ejection exit 31 and an illustrated position at which it is toward the switch-back section 35.

On one conveying path to which switching is made by the gate 34, a pair of rollers 36, 37 is provided for feeding a sheet in a downward direction in the Figure by, while being rotated, receiving the sheet at their nip which has been sent from the feed roller pair 32. The roller 36 is provided to the left of the conveying path and functions as a drive roller 36 which can change the rotation speed. The roller 37 provided to the right of the conveying path functions as a driven roller 37 which is rotated with the rotation of the drive roller 36.

The other conveying path to which the switching is made by the gate 34 is connected through a later-described pair of ejection rollers 44 to an ejection exit 31. On the ejection exit 31 a tray 110 is detachably mounted to allow those sheets which are ejected via the ejection exit 31 toward the outside of the machine to be stacked thereon.

Further below the roller pair (36, 37), a back feed preventing gate 38 is provided for preventing a back feed of the sheet and a switch 39 is provided for detecting the passage of a trailing edge of the sheet. The back feed preventing gate 38 is normally urged in an indicated posture toward a counterclockwise direction to allow the passage of the sheet coming from the fixing unit 22 and prevent a back feed of the sheet toward the fixing unit 22.

Another driven roller 42 is set in rolling contact with the drive roller 36 in a position left to the drive roller 36 in the Figure. That is, the sheet which is sent in a backward direction from the switch-back section 35 is guided by the back feed preventing gate 38 into a nip between the rollers 36 and 42. Just before the nip between the rollers 36 and 42 a sensor 43 is provided for detecting the passage of a trailing edge of the sheet. The sheet which is passed through the nip between the rollers 36 and 42 is passed over to a nip of the ejection roller pair 44 (speed reducing mechanism) and reduced in speed and, after this, it is ejected via the ejection exit 31. At that time, the passage of the sheet is detected by a switch 45.

Further below a switch 39 in the Figure, a pair of speed-variable and rotation-reversible conveying rollers 46 is provided. A pair of reverse turn rollers 47 is provided on the right below the conveying roller pair 46. The rollers 47 have their speed reduced with the sheet received in their nip and stopped. After this, the speed of the rollers 47 is increased in a reverse direction to allow the sheet to be sent in the reverse direction, so that the conveying direction of the sheet is reversed with its surface side inverted.

A back feed preventing gate 48 is provided between the conveying roller pair 46 and the reverse turn roller pair 47. The gate 48 allows the passage of the sheet from the conveying roller pair 46 toward the reverse turn roller pair 47 and prevents the back feed of the sheet toward the conveying roller pair 46 past it.

The speed at which the sheet is fed by the drive roller 36 is the first speed that is equal to or higher than the process speed. In the present embodiment, the peripheral speed of the drive roller 36 is accelerated from about 400 mm/s to 800 mm/s. Further, the speed at which the sheet is set out by the ejection roller pair 44 is so controlled as to be set to a second speed at least lower than the speed (first speed) at which the sheet is sent by the drive roller 36. In the present embodiment, the peripheral speed of the ejection roller pair 44 is decelerated from about 800 mm/s to 400 mm/s. The ejection speed of the sheet decelerated through the ejection roller pair 44 is preferably of the order of 90 to 110% of the process speed.

Figure 3:
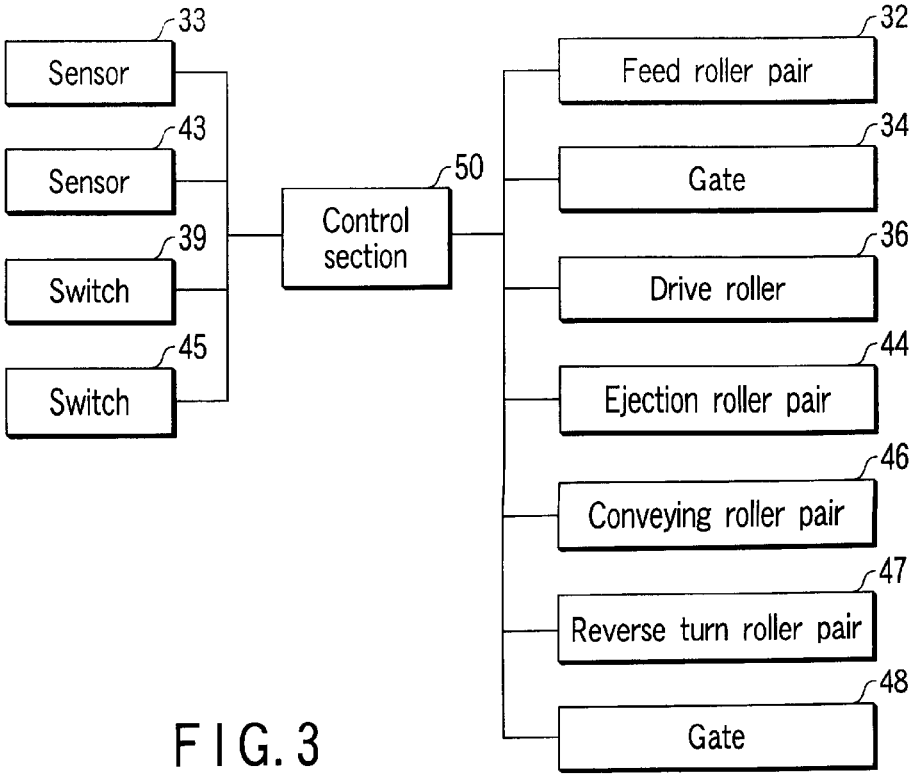
FIG. 3 is a block diagram showing a control system for controlling the operation of the sheet ejection mechanism in FIG. 2.

FIG. 3 is a block diagram showing a control system for controlling the operation of the ejection mechanism 30.

To a control section 50 for controlling the operation of the ejection mechanism 30, sensors 33, 34 and switches 39, 45 are connected at their predetermined positions, the sensors detecting the passage of a trailing edge of the sheet in the conveying direction. To the control section 50 are connected the feed roller pair 32, gate 34, drive roller 36, ejection roller pair 44, conveying roller pair 46, reverse turn roller pair 47 and gate 48.

An explanation will now be made below about a first practical operation example by the ejection mechanism 30 thus set out above. Here, an explanation will be made about the case where a plurality of plain sheets continuously conveyed at a predetermined conveying pitch and having an image formed on one surface are ejected with the image-formed surface down, that is, ejected, in such a manner, via the ejection exit 31 onto the tray 110 for stacking.

First, a sheet is sent, at the process speed, from the image forming section through a nip of the fixing unit 22. The sheet which has been sent from the fixing unit 22 is passed over to the feed roller pair 32 and, while being maintained at the process speed, conveyed. Here, the process speed is set to about 400 mm/s. At this time, the gate 34 is switched to a posture as shown in FIG. 2 and the leading edge of the sheet in the conveying direction is oriented toward the switch-back section 35. The sheet which has been passed through the gate 34 is guided into a nip between the paired rollers 36, 37 and sent further downward at the process speed.

In the timing at which the trailing edge of the sheet in the conveying direction is passed through the sensor 33, the drive roller 36 is accelerated and the conveying speed of the sheet is increased to the first speed. Here, the first speed is set to about 800 mm/s. At the same time, the rotation speeds of the conveying roller pair 46, reverse turn roller pair 47 and ejection roller pair 44 are also increased to the first speed.

In the timing at which the leading edge of the sheet is passed through the switch 39, the peripheral speeds of the conveying roller pair 46 and reverse turn roller pair 47 are reduced and stopped. And the conveying roller pair 46 and reverse turn roller pair 47 are accelerated in a reverse direction to allow the conveying direction of the sheet to be reversed. At this time, the conveying roller pair 46 and reverse turn roller pair 47 are accelerated in a reverse direction up to the first speed. In this connection it is to be noted that, after the trailing edge of the sheet has been passed through the switch 39, the drive roller 36 continues its rotation at the first speed.

Thus, the switched-back sheet is directed by the back feed preventing gate 38 toward a nip between the roller pair 36, 42. At this time, the drive roller 36 is rotated at the first speed and, therefore, the sheet is sent, at the first speed, by the roller pair 36, 42 toward the ejection roller pair 44.

In the timing at which the trailing edge of the sheet in the conveying direction is passed through the sensor 43, the ejection roller 44 being rotated at the first speed is decelerated down to a second speed corresponding to about the process speed and the sheet in the decelerated conveying state is ejected via the ejection exit 31 toward the outside of the machine. Those sheets thus ejected toward the outside of the machine are sequentially stacked on the tray 110. After the trailing edge of the sheet has been passed through the sensor 43, the drive roller 36, conveying roller pair 46 and reverse turn roller pair 47 are decelerated down to about the process speed, thus making ready for the next sheet reverse turn operation.

Figure 4:
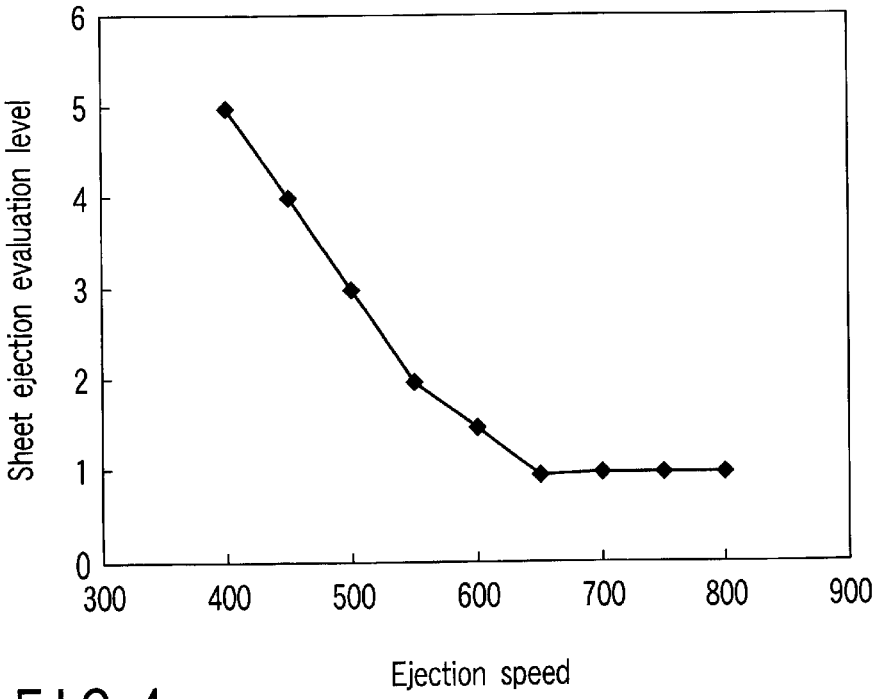
FIG. 4 is a graph showing a variation of an evaluation level against the sheet ejection speed.

FIG. 4 is a graph showing an evaluation level of the ejected sheet state against the sheet ejection speed. The evaluation of the ejected sheet state is made by ranking ejected sheets in terms of their curled state, their stacked number, their arrayed states upon stacking, etc., and, in this case, the better the ejected sheet states, the higher rank is given to them. From this graph it is found that, the lower their ejection speed, the better their ejected state. If, however, the ejection speed of the sheet is lower than 90% (about 360 mm/s) of the process speed, then the sheet-to-sheet feed pitch cannot be secured and the conveying state of the sheet is made worse, thus causing an inconvenience, such as sheet jamming. If, on the other hand, the ejection speed of the sheet exceeds 110% (440 mm/s) of the process speed, then the sheet is ejected from the tray 110. According to the present invention, therefore, the deceleration speed by the ejection roller pair 44, that is, the second speed, is set to about 90 to 110% of the process speed.

According to the first practical operation example, as set out above, the conveying speed of the sheet is more increased than the process speed to pass through the switch-back section and it is possible to avoid a sheet-to-sheet collision at the switch-back section even if the conveying pitch is relatively short. Further, according to the first practical operation example, when the sheet is ejected via the ejection exit 31 onto the tray 110, the ejection speed of the sheet is reduced down to about the process speed and it is, therefore, possible to prevent the sheet from being ejected past the tray 110. Further, by reducing the ejection speed of the sheet it is also possible to set sheets on the tray 110 under an arrayed condition.

Next, an explanation will be made below about a second practical operation example of the ejection mechanism 30. Here, an explanation will be made about the case where thicker sheets are ejected via the ejection exit 31 in an inverted state onto the tray 110 for stacking. In this case it is assumed that the conveying pitch of the thicker sheet is set to an adequately longer distance than the length of the thicker sheet along a conveying direction.

First, the thicker sheet which is sent out from the fixing unit 22 at the process speed is sent via the gate 34 into the switch-back section 35. At this time, the drive roller 36, conveying roller pair 46, reverse turn roller pair 47 and ejection roller pair 44 have their rotation speeds controlled to about the process speed and the thicker sheet is inverted at the same speed as the process speed.

In the timing at which the trailing edge of the thicker sheet in the conveying direction sent out from the switch-back section 35 is passed through the sensor 43, the paired ejection rollers 44 rotated at the process speed have their speed reduced and the thicker sheet is ejected onto the tray 110 at a lower ejection speed than the process speed.

According to the second practical operation example, as set out above, the thicker sheet fed at an adequate conveying pitch is inverted without increasing its speed and ejected at a lower ejection speed than the process speed. Even if, therefore, the thicker sheet of a relatively great weight is used, it can be prevented from being ejected from the tray 110 when it is ejected via the ejection exit 31 and it is possible to improve the arraying of the sheets on the tray 110.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, although, in the above-mentioned first and second practical operation examples, the plain sheet, thicker sheet, etc., have been explained as being ejected after their one surface side has been inverted, if the sheet is ejected without being inverted, it is only necessary to guide a sheet fed from the feed roller pair 32 directly to the ejection roller pair 44 through the gate 34. In particular, where the thicker sheet is to be ejected without being inverted, it is possible that, in the timing at which the trailing edge of the thicker sheet in the conveying direction is passed through the sensor 33, the pair of ejection rollers 44 have their speed reduced to an ejection speed less than the process speed and the thicker sheet is ejected onto the tray 110. By doing so, it is possible to prevent the thicker sheet from being ejected.

Further, it may be possible to selectively perform speed increasing control at the switch-back section in accordance with the conveying pitch of the sheet. That is, where the conveying pitch of the sheet is shorter than the length of the sheet in the conveying direction, the conveying speed of the sheet passed through the switch-back section 35 may be increased and, where the conveying pitch of the sheet is longer than the sheet length, the sheet may be inverted at the same speed as the process speed.

What is claimed is:

1. A sheet ejection mechanism comprising:

an ejection exit for allowing a sheet which is conveyed at a predetermined process speed through an image forming section to be ejected toward an outside of an image forming machine, the sheet having an image formed at least on one surface;

a feeding mechanism for feeding the sheet, which is sent from the image forming section, at a first speed higher than the process speed toward the ejection exit; and a speed reducing mechanism, provided near the ejection exit, for allowing the sheet which is sent by the feeding mechanism to be decelerated to a second speed lower than the first speed.

2. A sheet ejection mechanism according to claim 1, wherein the second speed is 90 to 110% of the process speed.

3. A sheet ejection mechanism according to claim 1, wherein a tray is provided at an ejection exit to allow those sheets which are ejected through the speed reducing mechanism to be stacked thereon.

4. A sheet ejection mechanism comprising:

an ejection exit for allowing a sheet which is conveyed at a predetermined process speed through an image forming section to be ejected toward an outside of an image forming machine, the sheet having an image formed on one surface;

a switch-back section for allowing the sheet which is sent from the image forming section to be conveyed at a first speed higher than the process speed, the switch-back section turning a sheet conveying direction to a reverse direction to invert the sheet from one surface side to the other surface side; and a speed reducing mechanism, provided near the ejection exit, for allowing the sheet which is sent from the switch-back section to be decelerated to a second speed lower than the first speed and to be ejected via the ejection exit.

5. A sheet ejection mechanism according to claim 4, wherein the process speed is of the order of 400 mm/s.

6. A sheet ejection mechanism according to claim 4, wherein the second speed is 360 mm/s to 440 mm/s.

7. A sheet ejection mechanism according to claim 4, wherein a tray is provided at the ejection exit to allow those sheets which are ejected through the speed reducing mechanism to be stacked thereon.

8. A sheet ejection mechanism comprising:

an ejection exit for allowing a plurality of sheets which are conveyed at a predetermined conveying interval and at a predetermined process speed through an image forming section to be continuously ejected to an outside of an image forming machine, the respective sheet having an image formed on one surface;

a switch-back section for allowing the respective sheets which are sent from the image forming section to be conveyed at a first speed and their conveying direction to be sequentially turned to a reverse direction to invert the sheet from one surface side to the other surface side;

a speed reducing mechanism, provided near the ejection exit, for allowing the respective sheets which are sent from the switch-back section to be decelerated to a second speed lower than the first speed and to be sequentially ejected via the ejection exit; and a control section for controlling the first speed to approximately the process speed when the conveying interval is longer than the length of the sheet along the conveying direction and the first speed to a higher speed than the process speed when the conveying interval is less than the length of the sheet along the conveying direction.

9. A sheet ejection mechanism according to claim 8, wherein the second speed is 90 to 110% of the process speed.

10. A sheet ejection mechanism according to claim 8, wherein a tray is provided at the ejection exit to allow the plurality of sheets to be stacked thereon.

* * * * *